US011346603B2

(12) United States Patent
Hirose et al.

(10) Patent No.: US 11,346,603 B2
(45) Date of Patent: May 31, 2022

(54) GAS PRODUCTION SYSTEM

(71) Applicant: L'Air Liquide, Societe Anonyme pour l'Etude et l'Exploitation des Procedes Georges Claude, Paris (FR)

(72) Inventors: Kenji Hirose, Kobe (JP); Shinji Tomita, Kobe (JP)

(73) Assignee: L'Air Liquide, Societe Anonyme Pour L'Etude Et L'Exploitation Des Procedes Georges Claude, Paris (FR)

( * ) Notice: Subject to any disclaimer, the term of this patent is extended or adjusted under 35 U.S.C. 154(b) by 232 days.

(21) Appl. No.: 16/617,141

(22) PCT Filed: May 18, 2018

(86) PCT No.: PCT/EP2018/063050
§ 371 (c)(1),
(2) Date: Nov. 26, 2019

(87) PCT Pub. No.: WO2018/219685
PCT Pub. Date: Dec. 6, 2018

(65) Prior Publication Data

US 2020/0182543 A1 Jun. 11, 2020

(30) Foreign Application Priority Data

May 31, 2017 (JP) ..... JP2017-108129

(51) Int. Cl.
*F25J 3/00* (2006.01)
*F25J 3/04* (2006.01)

(52) U.S. Cl.
CPC ..... *F25J 3/04066* (2013.01); *F25J 3/0409* (2013.01); *F25J 3/0426* (2013.01); (Continued)

(58) Field of Classification Search
CPC .. F25J 1/00; F25J 1/0002; F25J 1/0012; F25J 1/0015; F25J 1/0032; F25J 1/0035; (Continued)

(56) References Cited

U.S. PATENT DOCUMENTS 4,867,773 A * 9/1989 Thorogood ..... F25J 3/04284 62/652
5,408,831 A 4/1995 Guillard et al.
(Continued)

FOREIGN PATENT DOCUMENTS

EP 2 053 329 4/2009
EP 3 193 114 7/2017
(Continued)

OTHER PUBLICATIONS

International Search Report and Written Report for PCT/EP2018/063050, dated Aug. 2, 2018.

*Primary Examiner* — John F Pettitt, III
*Assistant Examiner* — Erik Mendoza-Wilkenfel
(74) *Attorney, Agent, or Firm* — Justin K. Murray

(57) ABSTRACT

A gas production system that can supply liquefied gas obtained by rectifying source gas as product gas continuously with high heat efficiency without using a machine that has a risk of contamination like a pump. A gas production system includes a single pressure device having a single pressurized container to which liquefied gas extracted from a rectification unit is supplied, a pressure line for extracting and vaporizing a part of the liquefied gas in the pressurized container and returning the part of the liquefied gas to the pressurized container, and a second heat exchange unit that is disposed in the pressure line, and a liquefied gas storage unit that stores liquefied gas which is led out from the pressurized container.

11 Claims, 4 Drawing Sheets

(52) U.S. Cl.
CPC ..... *F25J 3/0443* (2013.01); *F25J 3/04321* (2013.01); *F25J 3/04381* (2013.01); *F25J 3/04496* (2013.01); *F25J 3/04781* (2013.01); *F25J 3/04836* (2013.01); *F25J 2210/42* (2013.01); *F25J 2235/04* (2013.01); *F25J 2235/50* (2013.01); *F25J 2245/50* (2013.01); *F25J 2250/20* (2013.01); *F25J 2250/50* (2013.01); *F25J 2290/62* (2013.01)

(58) Field of Classification Search
CPC ..... F25J 1/0037; F25J 1/0045; F25J 1/0075; F25J 2210/06; F25J 2215/42; F25J 2215/44; F25J 2240/02; F25J 2240/04; F25J 2240/12; F25J 2240/20; F25J 2240/22; F25J 2240/40; F25J 2240/46; F25J 2240/48; F25J 2245/50; F25J 2270/04; F25J 2270/06; F25J 3/00; F25J 3/04472; F25J 3/04478; F25J 3/04496; F25J 3/04484; F25J 3/0449
See application file for complete search history.

(56) References Cited

U.S. PATENT DOCUMENTS

| | | | | | |
|---|---|---|---|---|---|
| 5,596,885 | A | | 1/1997 | Grenier | |
| 6,006,546 | A | * | 12/1999 | Espie | F25J 3/04412 62/656 |
| 2016/0161180 | A1 | * | 6/2016 | Parsnick | F25J 3/0409 62/654 |
| 2016/0312904 | A1 | * | 10/2016 | Hoang | E21B 33/063 |

FOREIGN PATENT DOCUMENTS

| | | | | | |
|---|---|---|---|---|---|
| JP | H04 208385 | | | 7/1992 | |
| JP | H0961052 | A | * | 3/1997 | F25J 3/044 |
| JP | 2004197981 | A | * | 7/2004 | F25J 3/04284 |
| JP | 6 086272 | | | 3/2017 | |
| WO | 2014/173496 | | | 10/2014 | |

* cited by examiner

GAS PRODUCTION SYSTEM

CROSS REFERENCE TO RELATED APPLICATIONS

This application is a § 371 of International PCT Application PCT/EP2018/063050, filed May 18, 2018, which claims the benefit of JP2017-108129, filed May 31, 2017, both of which are herein incorporated by reference in their entireties.

FIELD OF THE INVENTION

The present invention relates to a gas production system that supplies liquefied gas obtained by rectifying source gas as product gas. As the liquefied gas, for example, liquid oxygen, liquid nitrogen, liquid argon and the like are cited.

BACKGROUND OF THE INVENTION

As an ordinary air separation device that produces liquid nitrogen from air, U.S. Pat. No. 5,596,885 and WO 2014/173496 are cited. The air separation device in U.S. Pat. No. 5,596,885 stores produced high purity liquid oxygen in a high purity liquid oxygen tank outside the air separation device at a pressure (for example, approximately 1.5 barA) of the low pressure rectification column. The high purity liquid oxygen is increased in pressure by using a high purity liquid oxygen pump, is evaporated by heat exchange with the source air or the like in the main heat exchanger of the air separation device, and is supplied as high pressure gas oxygen.

Further, the air separation device in WO 2014/173496 fills produced high purity liquid oxygen in a pressure device. The pressure device includes two or more high purity liquid oxygen pressurized containers, and an evaporator that pressurizes the high purity liquid oxygen by evaporating a part of the high purity liquid oxygen in the sealed pressurized container. In the pressure device, a series of basic operations is a batch cycle including the respective steps of filling the pressurized container with high purity liquid oxygen, pressurizing, supplying high purity liquid oxygen, and depressurizing.

Consequently, high purity liquid oxygen cannot be supplied continuously with the single pressurized container, but continuous supply of high purity oxygen is realized by combining two or more pressurized containers, and switching these pressurized containers.

However, in U.S. Pat. No. 5,596,885, a pump is used to increase pressure of the high purity liquid oxygen.

There is a possibility of inclusion of impurities in oxygen due to the structure of the pump, and above all, there is a great deal of concern about the influence of contamination in increasing the pressure of the high purity oxygen. Further, in WO 2014/173496, high purity liquid oxygen is supplied to the pressurized container from the oxygen production column by using a liquid head, so that the pressurized container needs to be placed in an air separation device cold box and at a lower portion of the oxygen production column, and therefore the pressurized container is subjected to capacity limitation.

Further, by placing two or more pressurized containers, the cold box becomes huge, facility cost becomes high because a number of switch valves are required to switch the two or more pressurized containers, and there is the problem of reduction in heat efficiency due to heat penetration from the environment.

In not only the case of high purity liquid oxygen production, but also the case of supplying other low temperature liquefied gases, for example, liquid nitrogen and liquid argon, similar problems by use of booster pumps are pointed out.

SUMMARY OF THE INVENTION

In the light of the aforementioned circumstances, an object of the present invention is to provide a gas production system that can supply liquefied gas obtained by rectifying source gas as product gas continuously with high heat efficiency without using a machine that has a risk of contamination such as a pump.

The present invention is a gas production system including a first heat exchange unit that cools source gas that is taken in from outside, and a rectification unit having one or two or more rectification columns for obtaining liquefied gas by rectifying liquefied source gas (liquid state) obtained by cooling in the first heat exchange unit, and includes:

a single pressure device having a single pressurized container to which liquefied gas extracted from the rectification unit is supplied, a pressure line for extracting and vaporizing a part of the liquefied gas in the pressurized container and returning the part of the liquefied gas to the pressurized container, and a second heat exchange unit (for example, a vaporizer or a pressure adjustment valve) that is disposed in the pressure line, a liquefied gas storage unit that stores liquefied gas which is led out from the pressurized container of the pressure device, and a product gas extraction line for increasing a temperature by causing liquefied gas to pass through the first heat exchange unit from the liquefied gas storage unit and to perform heat exchange with the source gas to supply the liquefied gas as product gas.

In the present invention, the gas production system may further include:

a source gas supply line that supplies the source gas to the rectification unit via the first heat exchange unit, a source gas flow rate measurement unit that is installed at an upstream side of the first heat exchange unit, of the source gas supply line, a first control valve that is installed upstream of the source gas supply line, and controls a supply amount of the source gas based on a flow rate measured by the source gas flow rate measurement unit, a product gas measurement unit that is installed at a downstream side of the first heat exchange unit, of the product gas extraction line and measures a value concerning product gas, and a second control valve that is installed in the product gas extraction line, and controls an extraction amount of the product gas based on a result measured by the product gas measurement unit.

The product gas measurement unit may be a single component of any one of a flow rate measurement unit that measures the flow rate of the product gas, a pressure measurement unit that measures pressure of the product gas, and a concentration measurement unit that measures a concentration of predetermined gas of the product gas, or a combination of one or more of them, for example.

In the present invention, the gas production system may further include:

a recycle source gas compressor that compresses waste gas (recycle source gas) that is extracted from a column upper portion of a rectification column at a most upstream side, of the rectification columns, an expansion turbine including an oil brake that expands waste gas extracted from the column upper portion of the rectification column at the most upstream side or waste gas extracted from a position different from an extraction position of the waste gas, and a control unit that controls an amount of Cold that is provided to the first heat exchanger, in accordance with variation of the product gas extraction amount.

One embodiment of the present invention further includes a first condenser that is disposed in the column upper portion of the rectification column at the most upstream side, and a second condenser that is disposed at a low position near the first condensation unit, wherein the recycle source gas compressor may compress waste gas (recycle source gas) that is extracted from a certain position (for example, an upper space thereof) of the first condenser, and the expansion turbine including the oil brake may expand waste gas that is extracted from a certain position (for example, an upper space thereof) of the second condenser.

One embodiment of the present invention may be configured to further include a single condenser that is disposed in the column upper portion of the rectification column at the most upstream side, wherein the recycle source gas compressor compresses waste gas that is extracted from a certain position of the condenser, and the expansion turbine including the oil brake expands the waste gas that is extracted from the certain position of the condenser.

One embodiment of the present invention may be configured to further include an introduction line that introduces liquid nitrogen or liquid oxygen, in the column upper portion of the rectification column.

According to the configuration, liquid nitrogen or liquid oxygen that is stored in the external tank can be introduced into the rectification column, so that a larger load variation can be handled. When oxygen-enriched liquefied gas that is in the lower portion of the rectification column decreases, oxygen-enriched liquefied gas that is fed to the condenser disposed in the column top portion of the rectification column also decreases. In the situation like this, liquid nitrogen or liquid oxygen stored in the external tank is introduced into the column top portion of the rectification column, whereby a condensing function can be kept. In the present invention, cold is recovered by evaporating liquefied gas (for example, high purity liquid oxygen) which is extracted from the liquefied gas storage unit, in the first heat exchanger. As a result, the amount of liquid nitrogen which is supplied from the rectification column as the cold source can be reduced.

In the present invention, the liquefied gas storage unit is disposed outside a cold box. In the cold box, at least the first heat exchanger, the rectification column, the expansion turbine, and the recycle source gas compressor may be disposed.

In the present invention, the recycle source gas compressor may be connected to the expansion turbine including the oil brake, and may be driven by the expansion turbine.

The gas production system of the present invention may include an expansion-turbine-integrated compressor, and a booster expander including an oil brake.

In the present invention, the recycle source gas may be fed from the column top (the air space of the first condenser) of the rectification unit to the recycle source gas compressor and compressed, subsequently may be fed to the first heat exchanger, and then may return to the lower portion of the rectification column.

In the present invention, the waste gas is fed to the expansion turbine via the first heat exchanger from the second condenser at a lower part than the first condenser in the rectification unit and is expanded, and subsequently is fed to the first heat exchanger. Thereafter, the waste gas may be discharged into the atmosphere.

In the present invention, the source gas which is introduced into the first heat exchanger may be compressed to a predetermined pressure by the compressor, or may be source gas from which impurities (for example, water, carbon dioxide and the like) are removed by a removal device after being compressed.

In the present invention, the single pressurized container is preferably installed below the rectification column.

In the gas production system like the present invention, the production amount variation of the product gas is adjusted by a capacity of the liquefied gas storage unit, and for example, for a large production amount variation, a liquefied gas storage unit with a larger capacity is required. In contrast with this, in WO 2014/173496, it is possible to respond to a production variation by continuously performing batch processing with two pressurized containers disposed in the cold box, and the pressurized containers are installed below the rectification column, so that the pressure devices undergo capacity restriction, or the cold box becomes huge.

On the other hand, in the present invention, the liquefied gas storage unit does not have to be installed in the cold box, and therefore does not undergo capacity restriction, a size of the cold box in the gas production system is not influenced, and the cold box is not made huge.

Further, according to the present invention, the liquefied gas which is obtained by rectifying source gas can be supplied as the product gas continuously with high heat efficiency, without using a machine having a risk of contamination like a pump.

Further, in the gas production system as the present invention, Cold needs to be adjusted, and it is important to supply Cold and keep a heat balance of a process, with respect to heat penetration to the cold box and heat loss in the heat exchanger.

According to the present invention, Cold with evaporation of liquefied gas (for example, high purity liquid oxygen) is efficiently recovered, power consumption of the gas production system (for example, an air separation system) can be reduced, and process control which is adapted to production amount variation of the product gas (for example, high pressure and high purity oxygen gas) can be performed.

Further, in the present invention, restriction to the source air relating to an evaporation amount of liquefied gas can be specified.

In the case of the source air having a liquefaction point lower than a boiling point of the liquefied gas, for example, in the case of high purity liquid oxygen, evaporation of high purity liquid oxygen of approximately 2% in a molar flow rate ratio is possible.

In order to evaporate the high purity liquid oxygen in that amount or more, source air at high pressure that has a higher liquefaction point than a boiling point of the liquefied gas may be supplied, and in order to obtain the high pressure, a booster for increasing the pressure of the source air may be used.

In the product gas extraction line, an automatic on-off valve for feeding liquefied gas may be provided.

The pressurized container may be provided with a pressure gauge that measures an inner pressure thereof, and a valve control unit that controls the automatic on-off valve which is disposed in the pressure line to feed the liquefied gas to the second heat exchanger so that a pressure value of the pressure gauge becomes a predetermined value.

A liquefied source gas buffer that stores the liquefied source gas may be included at a subsequent stage of the first heat exchange unit.

The liquid source gas buffer may be installed in the lower portion of the rectification column to which the liquefied source gas and the recycle source gas are introduced.

According to the above configuration, the evaporation amount of the liquefied gas (liquefied gas for being extracted as product gas) in the first heat exchanger may vary, in association with a variation of the consumption amount of the source gas, and with respect to this, an influence of the heat load variation onto the entire gas production system can be limited by applying the buffer (for example, a liquid air buffer) on the line of the fluid that performs heat exchange with the source gas (air or the like).

The control units may give an instruction to the first control valve, and control the supply amount of the source gas. The control unit may conduct control to decrease a variation of the supply amount by feedback control based on the flow rate measured by the source gas flow rate measurement unit.

The control unit may control the supply amount of the source gas based on a flow rate value obtained by measuring the flow rate of the recycle source gas in the compressor.

The control unit may calculate the amount of cold that is recovered in the first heat exchanger, from a flow rate of product gas which is measured in the product gas flow rate measurement unit, and control the expansion turbine including the oil brake based on the calculated amount of cold.

According to the configuration, the amount of Cold which can be recovered from the flow rate of the product gas (high purity oxygen) is calculated, and the amount of Cold which is further required to keep heat balance of the gas production system (the air separation function unit) is determined by a process balance. The cold source is controlled to obtain the determined amount of Cold. In the present invention, the cold source is an expansion turbine including an oil brake.

The control unit may control a flow rate of the expansion turbine, or control a load on the oil brake, in accordance with the amount of cold. As a method for controlling the expansion turbine including the oil brake that is the cold source, the oil brake may be adjusted by control of the oil flow rate that is used in braking, for example.

The oil brake can perform a function of supplying Cold by discharging heat to outside the cold box. Further, when the expansion turbine including the generator is used as the cold source, the function of supplying cold may be performed by recovering heat as electricity by the generator.

A flow meter that measures a flow rate of recycle gas may be provided in a recycle gas line that is formed among the rectification column, the recycle source gas compressor and the first heat exchange unit.

The gas production system may include:

a branch line that is branched at a previous stage of the first heat exchange unit of the product gas extraction line, a gate valve (for example, one or more automatic on-off valves or branch valves) that is installed in the branch line, and switches feeding of the liquefied gas to the branch line and/or the product gas extraction line, an extraction control unit that controls the gate valve to feed the liquefied gas to the branch line and/or the product gas extraction line, and a third heat exchange unit (a carburetor or a pressure adjustment valve) that is disposed in the branch line.

A terminal end of the branch line may be connected to the product gas extraction line.

The extraction control unit may control on and off of the gate valve to feed the liquefied gas to the branch line based on the flow rate measured by the product gas flow rate measurement unit.

The extraction control unit may control on and off of the gate valve to feed the liquefied gas to the branch line when the first heat exchange unit is stopped.

The source gas is air, for example.

The gas production system is an air separation device, for example.

The liquefied gas is, for example, liquid oxygen, high purity liquid oxygen, liquid nitrogen, high purity liquid nitrogen, liquid argon, and high purity liquid argon.

The product gas is, for example, oxygen gas, nitrogen gas, and argon gas, and may be high pressure gas and/or high purity gas.

The source gas is air, the rectification unit has a high pressure rectification column that rectifies liquid air, and a low pressure rectification column that leads out crude oxygen from which high-boiling-point components (for example, methane and the like) are removed from the high pressure rectification column to further rectify the crude oxygen, high purity oxygen which is extracted from the low pressure rectification column may be pressed by the pressure device, and may be introduced into the liquefied gas storage unit.

The high pressure rectification column may be a nitrogen production column. Nitrogen ($N_2$) can be extracted from the nitrogen production column.

The low pressure rectification column may be an oxygen production column.

The respective elements may be connected by piping, and in the piping or the respective lines, any one or more valves of an automatic on-off valve, a flow rate control valve and a pressure adjustment valve may be provided.

BRIEF DESCRIPTION OF THE DRAWINGS

Further features, advantages and possible applications of the invention are apparent from the following description of working and numerical examples and from the drawings. All described and/or depicted features on their own or in any desired combination form the subject matter of the invention, irrespective of the way in which they are combined in the claims the way in which said claims refer back to one another.

DETAILED DESCRIPTION OF THE INVENTION

Hereinafter, several embodiments of the present invention will be described. The embodiments described as follows describe examples of the present invention. The present invention is not limited to the following embodiments in any way, and also includes various modified modes that are carried out in a range without changing the gist of the present invention. All of components described as follows are not always essential components of the present invention.

Figure 1:
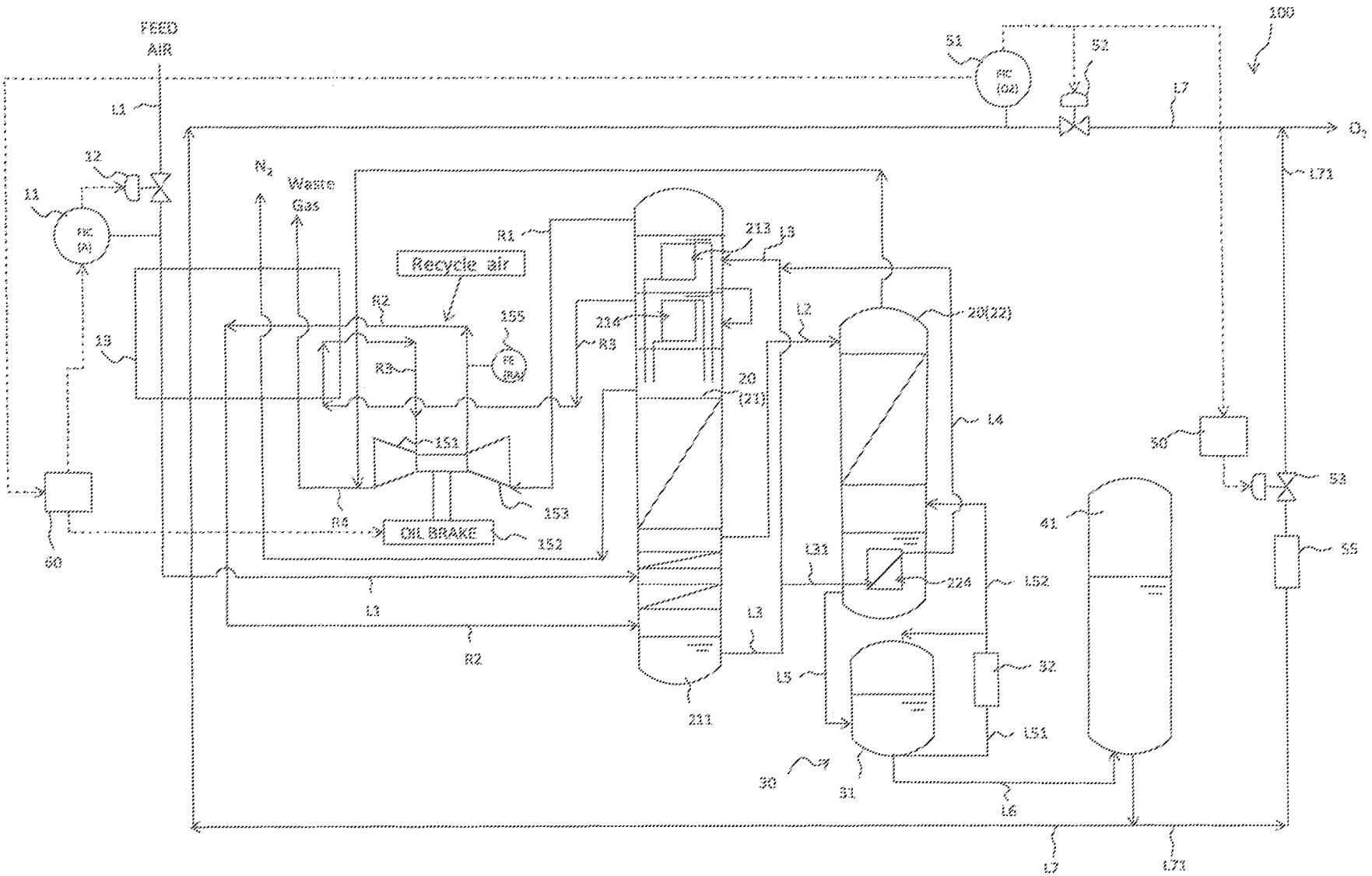
FIG. 1 is a diagram illustrating a configuration example of a gas production system of embodiment 1.

In the present embodiment, as illustrated in FIG. 1, a gas production system 100 includes respective elements of an air separation device that produces high purity liquid oxygen.

The gas production system 100 has an air supply line L1 for supplying air that is taken in from outside to a high pressure rectification column 21 via a first heat exchange unit 13. In the first heat exchange unit 13, air becomes liquefied air which is cooled, and is fed to a lower portion of the high pressure rectification column 21. Crude oxygen from which high-boiling-point components (for example, methane and the like) are removed is fed to an upper portion of a low pressure rectification column 22 through a line L2 from the high pressure rectification column 21.

In order to obtain a steam flow in the low pressure rectification column 22, liquefied air is supplied to a high purity oxygen evaporator 224 that is installed in a lower portion of the low pressure rectification column 22 as a heat source from a source liquid air buffer 211 in the high pressure rectification column 21 through a line L3 and a branch line L31 which branches from the line L3. The liquefied air joins the line L3 thereafter through a line L4, and is introduced into a first evaporator 213.

High purity liquid oxygen is obtained in the low pressure rectification column 22, and is fed to a pressurized container 31 of a pressure device 30 through a line L5. A part of the high purity liquid oxygen in the pressurized container 31 is fed to a second heat exchange unit 32 through a pressure line L51. In the second heat exchanger 32, the high purity liquid oxygen is vaporized, and returns to the pressurized container 31 through the pressure line L51. Note that a part of the vaporized high purity liquid oxygen may be configured to return to the low pressure rectification column 22 through a branch line 52.

In the present embodiment, in the pressurized container 31, a pressure gauge (not illustrated) that measures an inner pressure of the pressurized container 31, and a valve control unit (not illustrated) that controls an automatic on-off valve (not illustrated) that is disposed in the pressure line L51 to feed the high purity liquid oxygen to the second heat exchanger 32 so that a pressure value of the pressure gauge becomes a predetermined value may be provided.

From the pressurized container 31 of the pressure device 30, high purity liquid oxygen is fed to a storage unit 41 through a line L6 and is stored. The high purity liquid oxygen is fed from the storage unit 41 to the first heat exchange unit 13 through a product gas extraction line L7, is vaporized to be high pressure high purity oxygen gas, and is supplied as product gas. In the product gas extraction line L7, a product gas flow rate measurement unit 51 that measures a flow rate of the product gas, and a second control valve 52 that controls an extraction amount of the product gas based on the flow rate which is measured by the product gas flow rate measurement unit 51 are provided at a downstream side of the first heat exchange unit 13.

Further, a branch line L71 that branches at an upstream side from the first heat exchange unit 13 in the product gas extraction line L7, and a terminal end thereof is connected to the product gas extraction line L7 is provided. In the branch line L71, an automatic on-off valve 53 is provided. An extraction control unit 50 controls the automatic on-off valve 53 to feed high purity liquid oxygen to the branch line L71 and/or the product gas extraction line L7. A third heat exchange unit 55 is provided in the branch line L71. The extraction control unit 50 may control on and off, an opening degree and the like of the automatic on-off valve 53 to feed high purity liquid oxygen to the branch line L71 based on the flow rate measured by the product gas flow rate measurement unit 51 (in order to extract a necessary amount of product gas, for example). Further, the first heat exchange unit 13 is brought into a stopped state (at a time of the function of the air separation device being stopped or the like), the second control valve 52 is brought into a closed state, and on and off, the opening degree and the like of the automatic on-off valve 53 are controlled to feed the high purity liquid oxygen to the branch line L71. The high purity liquid oxygen that is fed to the branch line L71 is vaporized in a third heat exchanger 55 to be high pressure high purity oxygen gas and is supplied as the product gas.

In the present embodiment, the storage unit 41 is disposed outside the cold box, and in the cold box, the first heat exchange unit 13, the high pressure rectification column 21, the low pressure rectification column 22, an expansion turbine 151, a recycle source gas compressor 153, and the pressure device 30 are disposed.

Further, in the present embodiment, the lines L3, L31 and L4 are liquid air lines, the line L2 is a crude oxygen line, and the lines L5, L51, L52, L6, L7 and L71 are high purity liquid oxygen lines.

Process control method according to variation of product gas extraction amount

A source gas flow rate measurement unit 11 is provided at an upstream side of the first heat exchange unit 13 in the source gas supply line L1, and a first control valve 12 that controls a supply amount of source air based on the flow rate measured by the source gas flow rate measurement unit 11 is provided at an upstream side of the source gas flow rate measurement unit 11. Further, the expansion turbine 151 including an oil brake 152 that expands waste gas that is extracted from a second condenser 214 of the high pressure rectification column 21 is provided. A recycle air compressor 153 that compresses recycle air extracted from a column top of the high pressure rectification column 21 is provided.

The waste gas which is extracted from the second condenser 214 of the high pressure rectification column 21 is fed to the expansion turbine 151 through the first heat exchanger 13, the waste gas expands in the expansion turbine 151 to drive the turbine, and thereafter passes through the first heat exchanger 13 to be discharged into atmosphere. By drive of the expansion turbine 151, the recycle air compressor 153 drives via the oil brake 152. That is, the power required for compression is supplied from the connected expansion turbine 151 via the oil brake 152. The recycle air is fed to the recycle air compressor 153 from the first condenser 213 in the high pressure rectification column 21 to be compressed. Next, the recycle air is fed to the first heat exchanger 13, and subsequently returns to the lower portion of the high pressure rectification column 21. Note that the liquid air is fed to the second condenser 214 through the line not illustrated from the first condenser 213.

A control unit 60 controls the expansion turbine 151 including the oil brake 152 in accordance with a variation of the product gas extraction amount, and controls a treatment amount of the recycle air. For example, the control unit 60 calculates energy of cold (cold amount) that is recovered by the first heat exchange unit 13 from the flow rate of the product gas, which is measured by the product gas flow rate measurement unit 51, and controls a cold source based on the calculated energy of cold (the cold amount). In the present embodiment, the cold source is the oil brake 152.

In the present embodiment, a load relating to the cold source decreases by the amount of cold that is recovered by evaporation (extraction of the product gas) of the high purity liquid oxygen in the first heat exchanger 13 (the cold produced by the oil brake 152 decreases), whereby an amount of waste gas (high pressure air) which is introduced into the expansion turbine 151 decreases. Further, the cold that is discharged from the oil brake 152 similarly decreases, and the compressed power that can be recovered by the recycle air compressor 153 connected to the expansion turbine 151 increases, so that the treatment amount of recycle air can be increased, and the energy which is consumed by the recycle air compressor 153 can be reduced.

Further, with variation of the consumption amount of high purity oxygen, a cold supply amount of the devices (the first heat exchange unit 13, the high pressure rectification column 21 and the like) by high purity liquid oxygen varies. The variation amount can be evaluated by a variation of an amount of the liquid air that is stored in the air separation device (the rectification column or the like), for example. That is, when the evaporation amount of the high purity liquid oxygen is increased, the liquefied air amount increases, whereas when the evaporation amount decreases, the liquefied air amount decreases, and the source liquid air buffer 211 is provided in the device (the high pressure rectification column) so that the liquefied air amount does not become excessive or insufficient. In the present embodiment, the source liquid air buffer 211 is provided in the lower portion of the high pressure rectification column 21 at a lower portion from a position where the source air and recycle air are introduced.

The control unit 60 controls the load on the oil brake 151 in accordance with the amount of cold which is calculated.

In the first heat exchange unit 13, the compressor 15 and the high pressure rectification column 21, recycle gas lines (R1, R2) are formed, and recycle air flows. In the recycle gas line R2, a flow meter 155 that measures a flow rate of recycle gas is provided at an upstream side of the first heat exchange unit 13. A measurement value of the flow meter 155 is sent to the control unit 60. The control unit 60 controls a supply amount of the source air in accordance with the measurement value of the flow meter 155.

Further, waste gas is introduced into the expansion turbine 151 via the first heat exchange unit 13 through a discharge line R3 from the high pressure rectification column 21, and is discharged into atmosphere via the first heat exchange unit 13 through a discharge line R4.

An example of process control according to a production amount variation (an extraction amount variation) of high purity oxygen will be described. Note that similar process control also can be adopted for high purity nitrogen without being limited to high purity oxygen.

The production amount variation of high purity oxygen is controlled by the product gas flow rate measurement unit 51 and the second control valve 52 which are installed in the product gas extraction line L7.

The control unit 60 calculates energy of cold (the Cold amount) which is recovered, based on the flow rate of the product gas, which is measured in the product gas flow rate measurement unit 51, determines energy of cold that is further required to keep heat balance of the gas production system (an air separation function unit) based on a process balance, and controls the cold source to obtain the determined energy of cold. Further, the control unit 60 also controls the supply amount of the source air.

For example, the process control is executed as follows.

Cold that is given by liquid oxygen evaporation in the first heat exchange unit 13 is determined, the amount of cold which should be generated by the oil brake 152 which is disposed in the expansion turbine 151 and supplies cold is determined, and a variable that adjusts a load of the oil brake 152, such as an oil flow rate, for example, is determined.

In the air separation process, the recycle air compressor 153 is driven by the expansion turbine 151, and the treatment amount of the recycle air compressor 153 depends on the load on the oil brake 152. That is, when much cold is required, the treatment amount of the recycle air decreases when the load on the oil brake 152 is high, whereas when the load on the oil brake is low, the treatment amount of the recycle air increases.

Further, in order to keep the production amount of high purity oxygen, the total of the source air and recycle air needs to be fixed, and when the recycle air increases, the source air can be reduced.

Accordingly, the recycle air flow rate (measured by the flow meter 155) is uniquely determined in accordance with the above described load on the oil brake 151 which is determined, a difference between a total amount of air which should be supplied to the first heat exchange unit 13, the high pressure rectification column 21, the expansion turbine 151 and the recycle air compressor 153 (the air separation function unit), and the recycle air mount is calculated as the source air amount. Subsequently, based on the instruction from the control unit 60, the source air amount is controlled by the source air flow meter 11 and the first control valve 12.

The control unit 60 and the extraction control unit 50 may be realized by a cooperation of a computer including a processor and a memory, and a software program stored in a memory, or may be realized by a dedicated circuit, firmware and the like. Further, the control unit 60 may include an input/output interface and an output unit.

Figure 2:
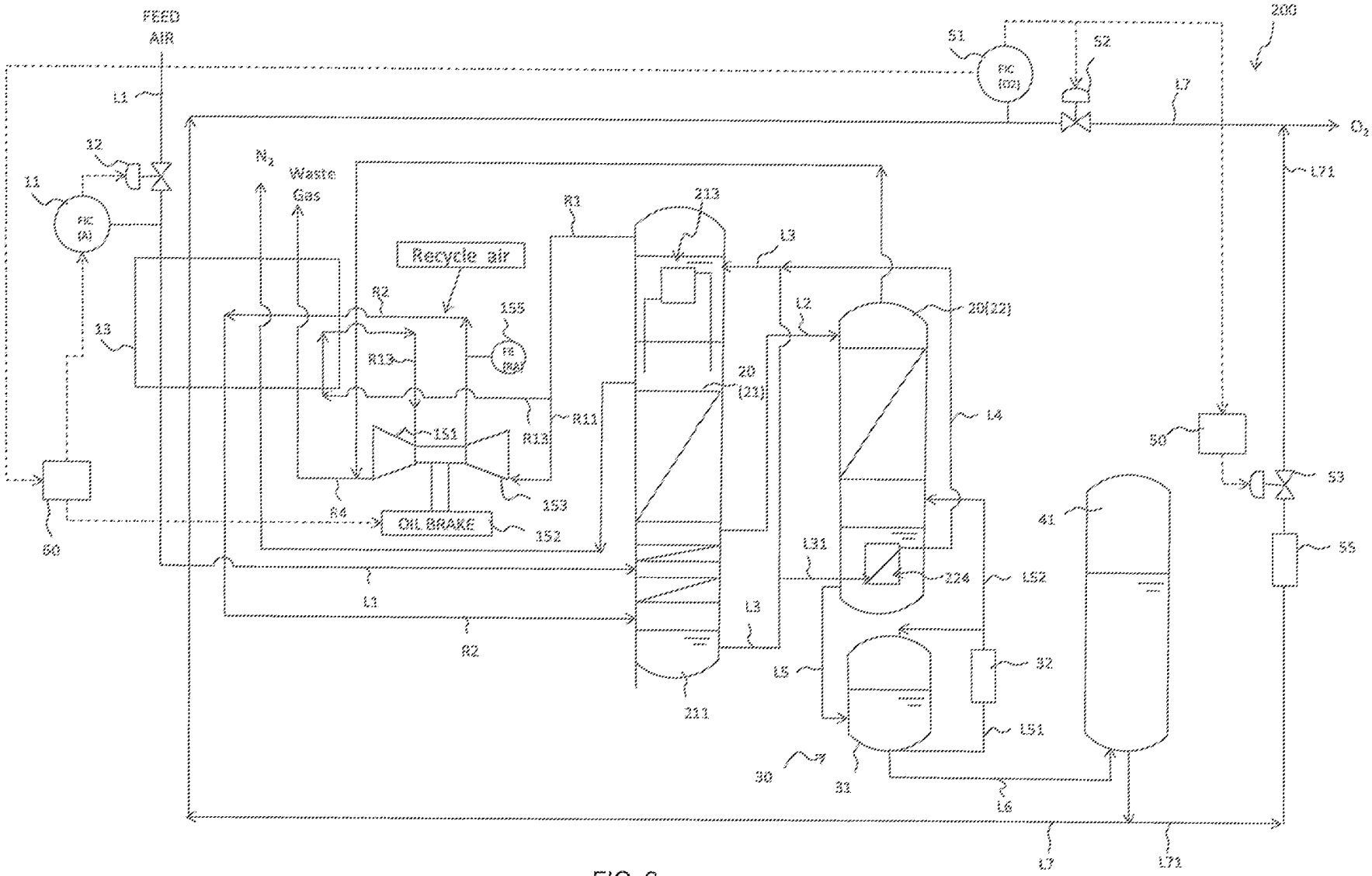
FIG. 2 is a diagram illustrating a configuration example of a gas production system of embodiment 2.

A configuration of embodiment 2 is illustrated in FIG. 2. A gas production system 200 includes respective elements of an air separation device that produces high purity liquid oxygen. The elements with the same reference signs as those in embodiment 1 and FIG. 1 have the same functions, and therefore, explanation thereof may be omitted.

In embodiment 1, the first condenser 213 and the second condenser 214 are included in the column upper portion of the high pressure rectification column 21 (the rectification column at a most upstream side), whereas in embodiment 2, only the single condenser 213 is included in the high pressure rectification column 21. Waste gas that is extracted from a certain position of the condenser 213 passes through the waste gas line R1, and is fed from the waste gas line R1 to the recycle source gas compressor 153 through a branch line R11 which branches from the waste gas line R1 and is compressed. Further, the waste gas is fed to the first heat exchanger 13 through a branch line R13 branching from the waste gas line R1 and is subjected to heat exchange, and thereafter, is fed to the expansion turbine 151 including the oil brake 152, where the waste gas is expanded. The functions of the expansion turbine 151 and the oil brake 152, and the function of the control unit 60 are similar to those in embodiment 1.

Figure 3:
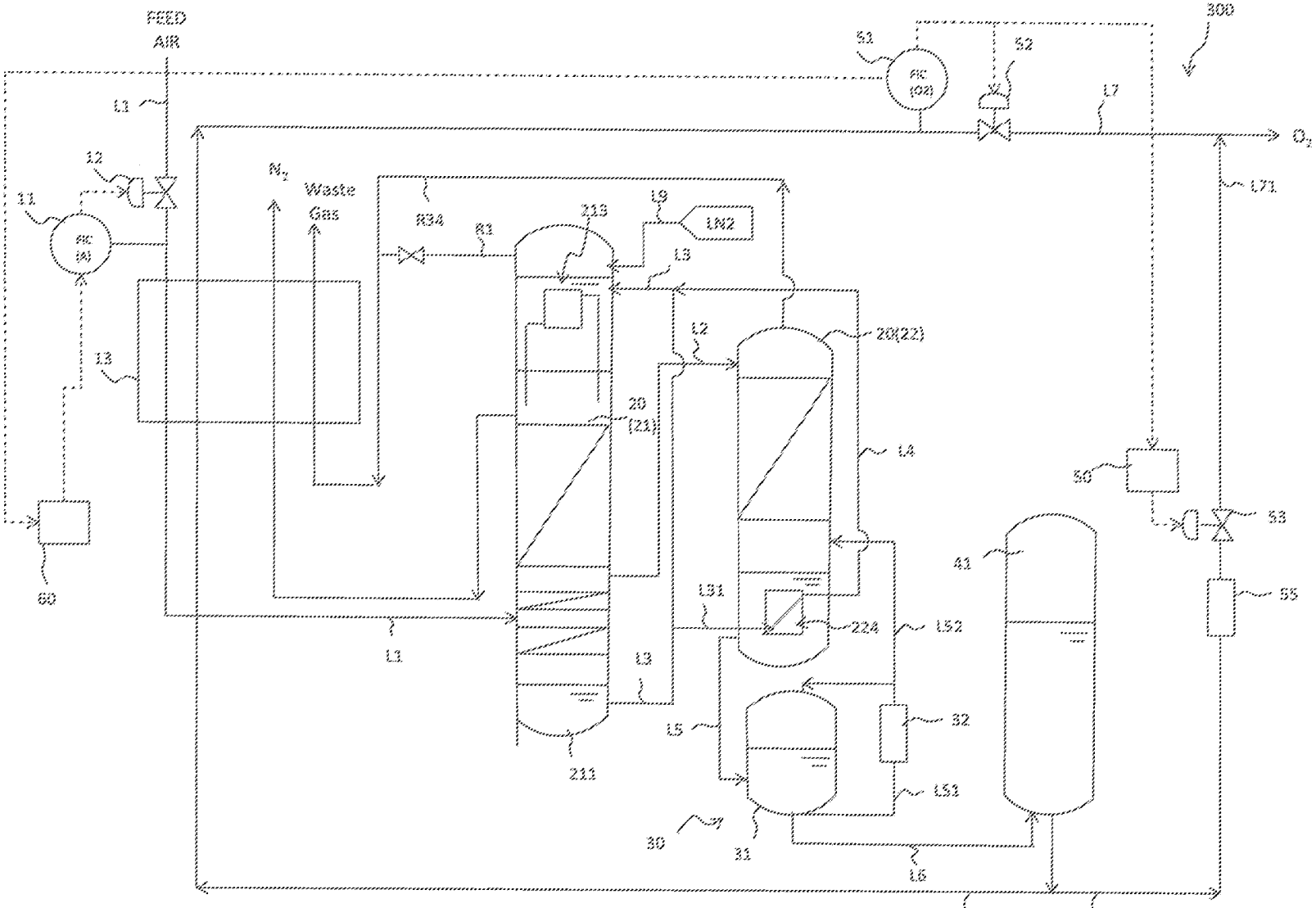
FIG. 3 is a diagram illustrating a configuration example of a gas production system of embodiment 3.

A configuration of embodiment 3 is illustrated in FIG. 3. The gas production system 300 includes respective elements of the air separation device that produces high purity liquid oxygen. The elements with the same reference signs of those in embodiments 1 or 2 and FIG. 1 or 2 have the same functions, so that explanation thereof may be omitted. Embodiments 1 and 2 each include the expansion turbine 151 having the oil brake 152, and the recycle source gas compressor 153, but embodiment 3 includes none of them, and is configured to store liquid nitrogen $LN_2$ in an external tank instead.

An introduction line L9 that introduces liquid nitrogen is included in a column upper portion of the high pressure rectification column 21 (the rectification column at the most upstream side). When oxygen-enriched liquefied gas in the source liquid air buffer 211 in the high pressure rectification column 21 decreases, oxygen-enriched liquefied gas that is fed to the condenser 213 disposed in the column top portion of the high pressure rectification column 21 also decreases. Therefore, liquid nitrogen stored in the external tank is introduced into the high pressure rectification column 21.

Further, waste gas that is extracted from column tops of the high pressure rectification column 21 and the low pressure rectification column 22 passes through waste gas lines R1 and R34 and is fed to the first heat exchanger 13.

Note that in the column upper portion of the high pressure rectification column 21, not only the first condenser 213 but also the second condenser 214 may be further included.

Figure 4:
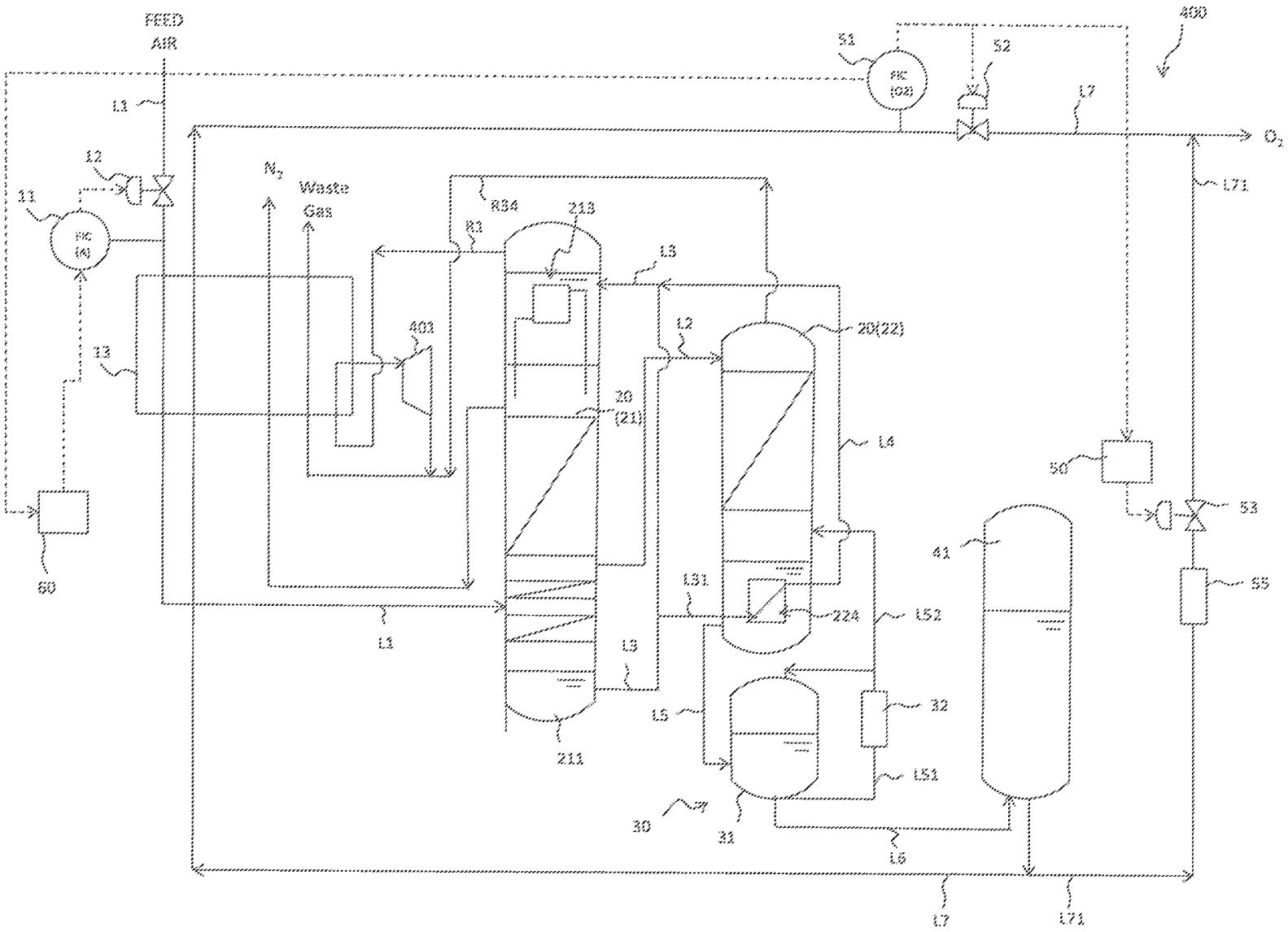
FIG. 4 is a diagram illustrating a configuration example of a gas production system of embodiment 4.

A configuration of embodiment 4 is illustrated in FIG. 4. A gas production system 400 includes respective elements of an air separation device that produces high purity liquid oxygen. Elements with the same reference signs as those in embodiments 1 to 3 and FIGS. 1 to 3 have the same functions, and therefore explanation will be omitted. In embodiments 1 and 2, the expansion turbine 151 having the oil brake 152 and the recycle source gas compressor 153 are included, whereas in embodiment 4, a configuration including an expansion turbine 401 is adopted.

Waste gas that is extracted from the low pressure rectification column 22 passes through the waste gas line R34, passes through the first heat exchanger 13 to perform heat exchange and is discharged into atmosphere. Further, waste gas that is extracted from the first condenser 213 of the high pressure rectification column 21 is fed to the expansion turbine 401 through the first heat exchanger 13, the waste gas expands here to drive the turbine, and thereafter passes through the first heat exchanger 13 to be discharged into atmosphere.

Note that in the column upper portion of the high pressure rectification column 21, not only the first condenser 213 but also the second condenser 214 may be further included.

In the present embodiment, the control unit calculates an amount of cold that is recovered by the first heat exchanger 13 from the flow rate of the product gas which is measured in the product gas flow rate measurement unit, and controls the expansion turbine 401 based on the calculated cold amount. The amount of cold that can be recovered is calculated from the flow rate of the product gas (high purity oxygen), and a cold amount that is further required to keep heat balance of the gas production system (the air separation function unit) is determined based on the process balance.

A cold source is controlled to obtain the determined cold amount. The cold source is the expansion turbine 401.

In embodiments 1 to 4 described above, the gas production system produces high purity liquid oxygen, but the gas production system is not limited to this, and may produce high purity liquid nitrogen, high purity liquid argon and the like.

In embodiments 1 to 4 described above, the branch line L71 and the third heat exchanger 55 are provided, but the present invention is not limited to this, and the branch line L71 and the third heat exchanger 55 may be omitted.

In embodiments 1 to 4 described above, the product gas flow rate measurement unit 51 (corresponding to the flow rate measurement unit) is used as the product gas measurement unit, but the present invention is not limited to this, and in place of the product gas flow rate measurement unit 51, a pressure measurement unit that measures the pressure of the product gas and/or a concentration measurement unit that measures a concentration of predetermined gas of the product gas may be used, or in addition to the product gas flow rate measurement unit 51, a pressure measurement unit that measures the pressure of the product gas and/or a concentration measurement unit that measures the concentration of the predetermined gas of the product gas may be used. In this case, the second control valve can control the extraction amount of the product gas based on the result of being measured in the above described product gas measurement unit.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

The invention claimed is:

1. A gas production system including a first heat exchange unit that cools a source gas that is taken in from external the gas production system, and a rectification unit having one or two or more rectification columns for obtaining a liquefied gas by rectifying the source gas after liquefaction obtained after cooling in the first heat exchange unit, the gas production system comprising:

a single pressure device having a single pressurized container to which the liquefied gas extracted from the rectification unit is supplied, a pressure line configured to extract and vaporize a part of the liquefied gas in the pressurized container and return the part of the liquefied gas to the pressurized container, and a second heat exchange unit that is disposed in the pressure line;

a liquefied gas storage unit configured to store the liquefied gas which is led out from the pressurized container of the pressure device;

a product gas extraction line configured to increase a temperature of the liquified gas by causing the liquefied gas to pass through the first heat exchange unit from the liquefied gas storage unit to perform heat exchange with the source gas and supply the liquefied gas as a product gas;

a recycle source gas compressor that compresses waste gas that is extracted from a column upper portion of one of the one or two or more rectification columns;

an expansion turbine including an oil brake that expands a second extracted from the column upper portion of the rectification column; and a control unit that controls an amount of cold that is provided to the first heat exchange unit, in accordance with variation of the product gas extraction amount.

2. The gas production system according to claim 1, further comprising:

a source gas supply line that supplies the source gas to the rectification unit via the first heat exchange unit;

a source gas flow rate measurement unit that is installed at an upstream side of the first heat exchange unit, of the source gas supply line;

a first control valve that is installed upstream of the source gas supply line, and controls a supply amount of the source gas based on a flow rate measured by the source gas flow rate measurement unit;

a product gas measurement unit that is installed at a downstream side of the first heat exchange unit, of the product gas extraction line and measures a value concerning the product gas; and a second control valve that is installed in the product gas extraction line, and controls an extraction amount of the product gas based on a result measured by the product gas measurement unit.

3. The gas production system according to claim 1, further comprising a first condenser that is disposed in the column upper portion of the rectification column at the most upstream side, and a second condenser that is disposed at a lower position near to the first condensation unit, wherein the recycle source gas compressor compresses the waste gas that is extracted from a certain position of the first condenser, and the expansion turbine including the oil brake expands the second waste gas that is extracted from a certain position of the second condenser.

4. The gas production system according to claim 1, further comprising a single condenser that is disposed in the column upper portion of the rectification column at the most upstream side, wherein the recycle source gas compressor compresses the waste gas that is extracted from a certain position of the condenser, and the expansion turbine including the oil brake expands the the second waste gas that is extracted from the certain position of the condenser.

5. The gas production system according to claim 1, further comprising an introduction line that introduces liquid nitrogen or liquid oxygen, in the column upper portion of the rectification column.

6. The gas production system according to claim 1, comprising a liquefied source gas buffer that stores the liquefied source gas, at a subsequent stage of the first heat exchange unit.

7. The gas production system according to claim 1, wherein the control unit calculates cold that is recovered in the first heat exchange unit, from a flow rate of the product gas, which is measured in the product gas flow rate measurement unit, and controls the expansion turbine including the oil brake based on the calculated cold.

8. The gas production system according to claim 7, wherein the control unit controls a flow rate of the expansion turbine, or controls a load on the oil brake, in accordance with the cold.

9. The gas production system according to claim 1, comprising:

a branch line that is branched at a previous stage of the first heat exchange unit of the product gas extraction line;

a gate valve that is installed in the branch line, and switches feeding of the liquefied gas to the branch line and/or the product gas extraction line;

an extraction control unit that controls the gate valve to feed the liquefied gas to the branch line and/or the product gas extraction line; and a third heat exchanger that is disposed in the branch line.

10. The gas production system according to claim 1, wherein the second waste gas comprises a portion of the waste gas.

11. The gas production system according to claim 1, wherein the second waste gas is extracted from a location within the column upper portion that is lower than where the waste gas is extracted from the column upper portion.

* * * * *